US006186437B1

(12) United States Patent
Ruha et al.

(10) Patent No.: US 6,186,437 B1
(45) Date of Patent: Feb. 13, 2001

(54) METHOD AND DEVICE FOR APPLYING A LOAD TO A REEL IN A REEL-UP OF A PAPER WEB

(75) Inventors: Pekka Ruha, Helsinki; Jouni Rantanen, Hyvinkää; Sakari Suoniemi, Mäntsälä, all of (FI)

(73) Assignee: Valmet Corporation (FI)

( * ) Notice: Under 35 U.S.C. 154(b), the term of this patent shall be extended for 0 days.

(21) Appl. No.: 09/307,287

(22) Filed: May 7, 1999

(30) Foreign Application Priority Data

May 7, 1998 (FI) ..... 981013

(51) Int. Cl.[7] ..... B65H 18/26
(52) U.S. Cl. ..... 242/541.7
(58) Field of Search ..... 242/541.7, 541.4, 242/547

(56) References Cited

U.S. PATENT DOCUMENTS

| | | | | |
|---|---|---|---|---|
| 3,834,642 | * | 9/1974 | Kampf | 242/547 |
| 4,049,212 | * | 9/1977 | Yamaguchi et al. | 242/541.4 |
| 4,744,526 | | 5/1988 | Kremar | 242/65 |
| 5,251,835 | | 10/1993 | Kyytsönen . | |
| 5,285,979 | | 2/1994 | Francesco . | |
| 5,375,790 | | 12/1994 | Svanqvist | 242/541.1 |
| 5,393,008 | | 2/1995 | Kyytsönen et al. | 242/541.1 |
| 5,611,500 | | 3/1997 | Smith | 242/541.4 |
| 5,713,534 | * | 2/1998 | McClenathan et al. | 242/541.4 |
| B1 4,634,068 | | 6/1997 | Malkki et al. | 242/541.7 |

FOREIGN PATENT DOCUMENTS

| | | |
|---|---|---|
| 1303000 | 9/1992 | (CA) . |
| 2210935 | 1/1998 | (CA) . |
| 4103799 | 8/1992 | (DE) . |
| 98506 | 5/1993 | (FI) . |

* cited by examiner

*Primary Examiner*—John M. Jillions
(74) *Attorney, Agent, or Firm*—Steinberg & Raskin, P.C.

(57) ABSTRACT

A method and device for applying a load to a reel in a reel-up of a paper web in which a reel spool and the reel wound around it from the paper web are is loaded against a reeling cylinder with a predetermined loading force supported by a supporting point. The supporting point of the loading force is located in a construction movable at least in the machine direction along with the reel spool. The construction is positioned with respect to a fixed supporting point in accordance with the growth of the reel by a transfer device located between the construction and the supporting point and operating by mechanical power transmission, and/or a carriage at least partly bearing the weight of the reel is used as the construction. The supporting point of the reel is transferred at least in the machine direction by the carriage. The loading force is produced by a force device acting between the supporting point in the moving construction and the reel spool. The loading force generated by the force device is adjusted during the reeling process. With the carriage, the reel can also be completely moved away from the reel-up.

30 Claims, 4 Drawing Sheets

FIG. 1
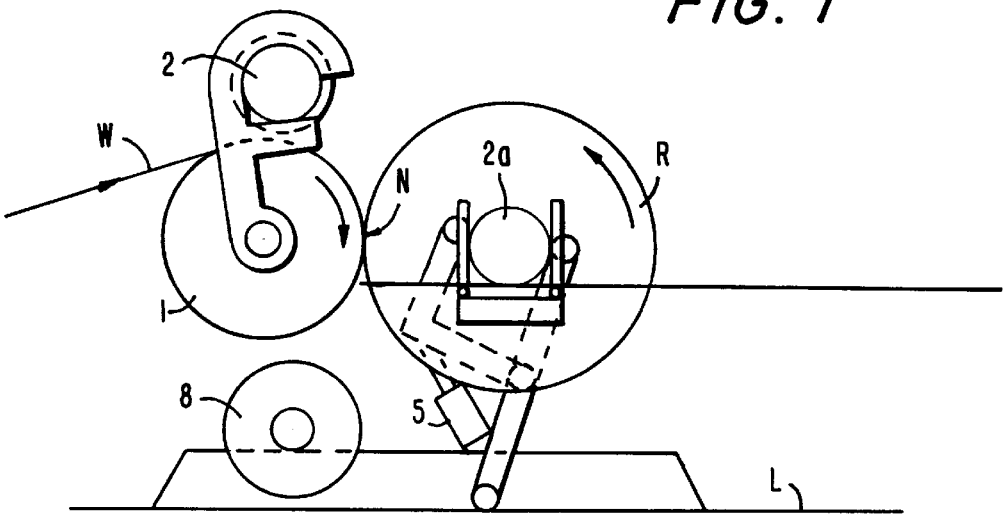
FIG. 2a
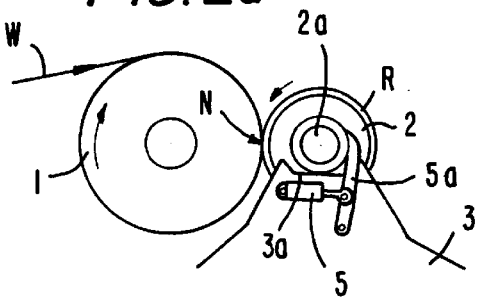
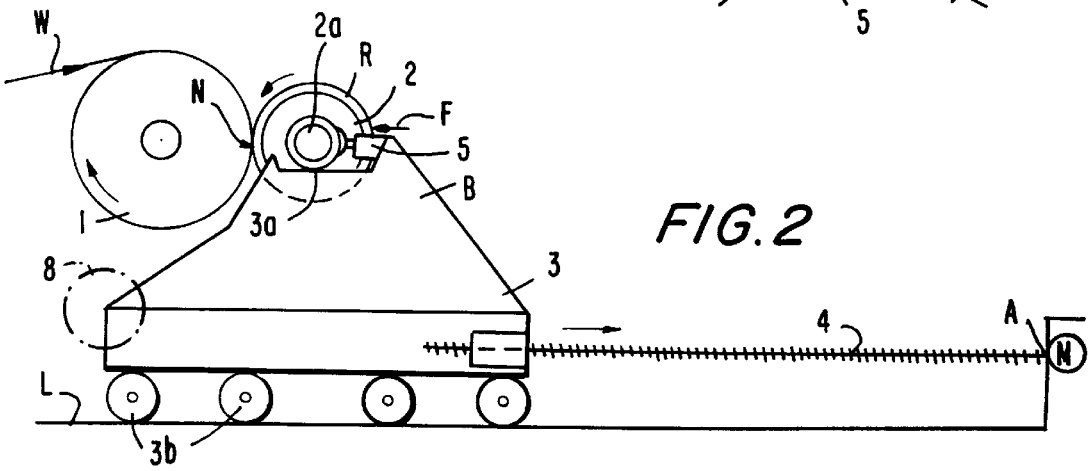
FIG. 2

METHOD AND DEVICE FOR APPLYING A LOAD TO A REEL IN A REEL-UP OF A PAPER WEB

FIELD OF THE INVENTION

The present invention relates to a method for applying a load to a reel.

The present invention also relates to a device for applying a load to a reel. In particular, the invention relates to the load of a machine reel in reel-ups of a paper web.

BACKGROUND OF THE INVENTION

In the final section of a paper machine or a corresponding machine which produces a continuous paper or fibrous web, the paper web passed from the preceding sections is accumulated into a machine reel in the reel-up. Such a reel is formed around a reel spool, which is loaded against a reeling cylinder by means of which the paper web is guided onto the reel. At least the reeling cylinder is driven, wherein it can simultaneously rotate a freely rotating reel, or the reel can be center-driven, i.e., the reel spool is driven during the reeling.

In a normal work cycle of a continuous reeling of a paper web, the reel is changed by cutting the paper web and arranging its end around a new, empty reel spool, the old full reel is removed from the reel-up and transferred to further processing, and the paper web is reeled around the new reel spool into a full-size machine reel. This process is repeated as often as necessary.

One factor that affects the quality of the thus-produced machine reel is the force which is used to load the reel against the reeling cylinder during the reeling process, and during the loading this force is changed on the basis of certain parameters or by using a suitable program. The loading force is produced by means of a force device, typically a hydraulic cylinder, coupled to the reel spool via a suitable mechanism. This hydraulic cylinder can be coupled for example to pivotal arms connected pivotally to the frame of the reel-up. This coupling method is described for example in Finnish Patent Nos. 71107 and 98506 and in U.S. Pat. No. 5,251,835, in all of which the reel spool is at the same time supported by horizontal reeling rails. For example, in U.S. Pat. No. 5,251,835, the full reel is transferred along the reeling rails into a discharge position, and a new reel spool is simultaneously brought onto the reeling rails.

In U.S. Pat. No. 5,285,979, the load is effected by means of a carriage which moves in the frame of a reel-up along linear guides, to which carriage a loading hydraulic cylinder is coupled. The reel spool is arranged on a pivotal arm connected pivotally to the carriage. The arm is used only when removing the full reel by turning the pivotal arms into the unloading direction with special unloading cylinders.

In all the above-described known reel-ups, the aforementioned force device is used to take care of both the desired loading force and the transfer of the reel spool further from the reeling cylinder when the size of the reel is increased.

The aforementioned solutions require a substantial motion length of the force device effecting the motion and the force. The actual loading force is affected by a number of factors, such as the friction produced by the motion of the force device, and in addition to that the dynamic friction of the structure supporting the reel spool, during the movement of the reel spool.

European Patent No. 0 604 558, corresponding to U.S. Pat. No. 5,393,008, describes carriages arranged to move linearly on guides disposed parallel to the reeling rails, the position of the carriages being determined by means of hydraulic cylinders coupled between the frame of the reel-up and the carriages. The carriages are provided with press devices, which press the bearing housings located at the ends of the reel spool and resting on the reeling rails, towards the reeling cylinder by an adjustable force. On the other side of the bearing housing, the carriages are also provided with positioning devices by means of which it is possible to adjust the position of the reel spool in the carriages more precisely.

OBJECTS AND SUMMARY OF THE INVENTION

Accordingly, an object of the invention is to provide a method and device for applying a load to a reel in a reel-up in which the reel is loaded against the reeling cylinder from the carriages themselves, which in turn, can be moved in another way with a transfer device separate from the force device applying the load. The nip force effective in the nip between the reeling cylinder and the reel is determined according to the function of the force devices (press devices) placed in the carriages, and in the operation of the load system, the possibilities of minimizing the friction factors which disturb the load are even better than before.

Another object of the invention is to present a new method in the reeling of a web as well as a reel-up in which the transfer of the reel spool and the load on the reel are differentiated even more than before and in which it is possible to utilize various solutions of machine automation.

In order to achieve these objects and others, the transfer motion of the reel spool is implemented with a mechanical positioning device, e.g., by means of a worm drive and/or a movable carriage which at least partly supports the weight of the reel spool and the reel. The actuators transmit the transfer force by means of mechanical power transmission to the structure moving the reel spool, and enable accurate positioning without requiring a pressurized medium, such as hydraulic oil, and without hydraulic cylinders of a long stroke length. On the other hand, when a carriage is used as a structure which moves in accordance with the growth of the reel and contains its own loading devices, the carriage receiving the weight of the reel spool and the growing reel, it is possible to abandon the stationary reeling rails. By means of the carriage supporting the reel, it is also possible to remove the reel from the reel-up for further processing.

As for the other preferred embodiments of the invention, reference is made to the description to follow. According to a preferred embodiment of the invention in particular, the carriage can also be utilized for transferring a full reel away from the reel-up, in other words, it can be used as a transport carriage for the machine reel.

Still another object of the invention is also to present a device for applying a load to a machine reel, the device being easier to control and being applicable to the reeling process with minor disturbance factors. To attain this object, the transfer device of the reel spool/reel which is separate from the force device, is a mechanical positioning device which can be selected and optimized on the basis of the required transfer length and other features, and/or the reel spool/reel is arranged on the support of a movable carriage.

As for the other preferred embodiments of the device, reference is made to the following description. In particular, mention is made of the possibility to arrange the structure of the carriage supporting the reel in such a way that in addition to the transfer in the machine direction during the reeling process, the carriage can be used for transferring a full machine reel completely away from the reel-up and for moving it outside the reel-up. To implement this, the carriage is equipped with wheels which are not dependent on the rails possibly running in the machine direction, i.e., in the incoming direction of the paper web. Such carriages can be equipped for example with turning wheels and with two separate sets of wheels, wherein the carriage can be removed in the reel-up in a direction different from the machine direction, for example transverse to the machine direction. It is also possible to use other conveying means on the support of which the carriage can be transferred in the machine direction and possibly completely removed from the reel-up. Such a carriage can be constructed in such a way that its structure closely resembles that of an automatic guided vehicle used for the transfer of goods.

BRIEF DESCRIPTION OF THE DRAWINGS

In the following, the invention will be described in more detail with reference to the appended drawings in which FIG. 1 shows a side view of a prior art reel-up;

FIGS. 2 and 2*a* show a side view of a reel-up at the initial stage of the reeling, the reel-up comprising a loading device according to the invention;

DETAILED DESCRIPTION OF THE PREFERRED EMBODIMENTS

Figure 3:
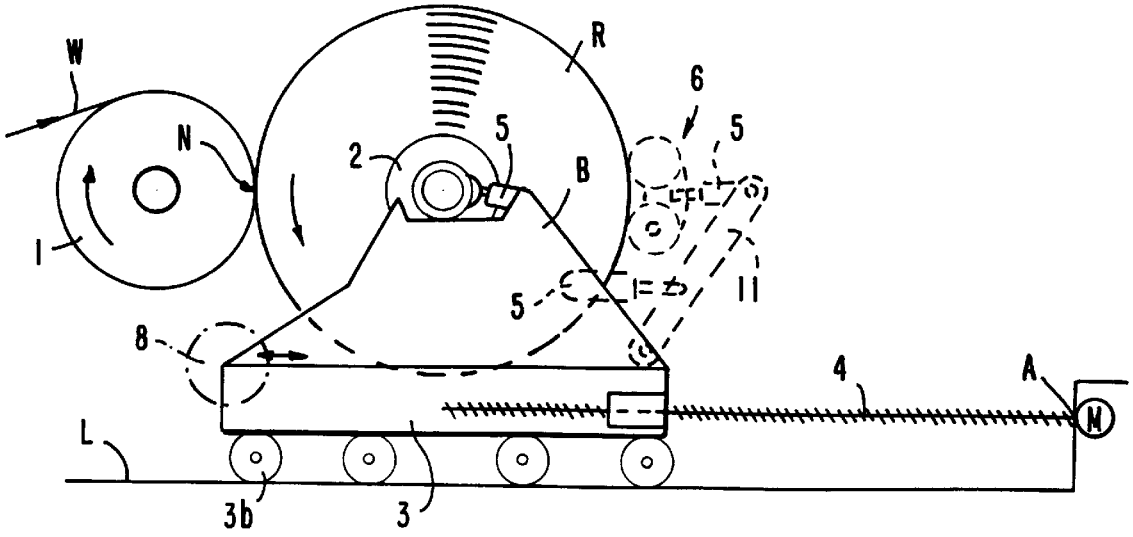
FIG. 3 shows the reel-up of FIG. 2 at the end of the reeling process.

Referring to the accompanying drawings wherein like reference numeral refer to the same or similar elements, FIG. 1 shows a prior art reel-up for a paper web in which the reference numbers for the corresponding parts are the same as in the following description. The reel-up of FIG. 1 is described in more detail in U.S. Pat. No. 5,251,835.

FIG. 2 shows a side view of a reel-up or winding station of a paper web which is a Pope-type reel-up of known principle. It should be understood that while only one side of the reel-up is illustrated, the other side of the reel-up corresponds to the side described. As to the general layout and principles of performing the reeling, starting from an empty reel spool and ending in a complete machine reel of paper, including transmitting drive to various rotational elements of the reel-up, reference is made to U.S. Pat. Nos. 5,251,835, 5,375,790 and 5,398,008, the entire disclosures of which are incorporated herein by reference. As is well known, the reel-up comprises a reeling cylinder 1 via which a continuous paper web W, passed from a paper machine, a coating machine or from another paper processing apparatus, is reeled around a reel spool 2 into a machine reel R. The reeling cylinder 1 guides the web W over a certain sector to nipping engagement with the machine reel. The reel is loaded against the reeling cylinder 1 by subjecting the reel spool 2 to a force of a desired magnitude directed towards the reeling cylinder 1. This generates a reeling nip N between the reel R and the reeling cylinder 1, in which reeling nip N there prevails a nip pressure of a certain level as a result of the load. The reel spool 2 is advantageously also provided with a center drive 2*a*, wherein the reel-up in question is a centerdrive assisted Pope reel-up, in which the torque of the reel spool 2 can also be utilized to influence the quality of the reel R which is being produced.

The reeling cylinder is rotatably journalled in the frame of the reel-up which is stationary with respect to a supporting base L, e.g., the floor level of a factory. The reel spool 2, in turn, is placed on a carriage 3 separate from the frame, to be carried by supports 3*a* located in the carriage. The supports can be horizontal guides which are located at both ends of the reel spool 2 and support the ends of the reel spool 2 by their bearing housings and at the same time, the weight of the reel. The supports 3*a* allow at least a short linear movement of the reel spool 2 on the carriage 3. In other words, the carriage 3 is of such a type that, excluding the weight possibly received by the reeling cylinder 1, the carriage supports the entire weight of the reel spool 2 and the reel R, and reeling rails having a fixed position are not necessary in the frame of the reel-up, on the support of which reeling rails the ends of the reel spool rest in known Pope-type reel-ups and along which the reel spool moves when the reel grows in size. The supports 3*a* are supporting bases located at a fixed height in the reel-up, but they can be fixed to the carriage to be pivotable with respect to the point of articulation on the carriage in such a way that they can be turned in the vertical plane when necessary, as will be described below. Both supports 3*a* are connected to the same structure which moves in the longitudinal direction of the reel-up in a way described below.

The carriage 3 is arranged to move linearly with respect to the reeling cylinder 1 in order to move the supporting point of the reel R, i.e., the point of contact between the ends of the reel spool 2 and the supports 3*a*, and the possibility of motion includes both directions, i.e., the carriage 3 can be moved back and forth when necessary. Thus, the lower section of the carriage is provided with conveying means with which the carriage can be moved at least in the machine direction with respect to the supporting base L. In the embodiment illustrated in the drawing, the motion is made possible by wheels 3*b* provided in the carriage, on the support of which wheels 3*b*, the carriage 3 is arranged to move on top of the supporting base L. The wheels are directed in the machine direction, i.e., in the traveling direction of the web W to guide the linear motion of the carriage to the machine direction. The wheels 3*b* are not necessarily in a direct contact with the approximately horizontal supporting base L, but they can be positioned on stationary linear guides on a higher level or they can be guided by rails located in the plane of the supporting base L.

The wheels which operate by a rolling contact, are not the only possibility for moving the carriage 3, but other arrangements, such as magnetic guides, air cushions, or the like, can also be used, which have a sufficiently small friction with the structure with respect to which they move along with the motion of the carriage.

FIG. 2 shows a momentary situation in which the carriage 3 is located in a position determined by the thickness of the reel R with respect to the reeling cylinder 1. In order to attain the desired nip load (nip pressure), the reel R is loaded against the reeling cylinder 1 with a predetermined loading force F by acting on the reel spool 2 with a force device. Force devices, one in each end of the reel R, are designated by reference number 5, and they are effective between the supporting point B in the carriage and the end of the reel spool 2, in contact with the bearing housings at the ends of the reel spool. The reel spool, in turn, is moved further away from the reeling cylinder 1 when the reel is growing, i.e., when the radius of the reel increases, by moving the entire carriage 3 by means of a transfer device 4 of the carriage 3, which transfer device is effective between the carriage 3 and a supporting point A, which is in a fixed position with respect to the supporting base L. When the reeling process proceeds, both the force device 5 and the transfer device 4 function simultaneously in such a way that the desired load is attained by means of the force device 5, and the transfer device 4 is used for moving the carriage 3 as the diameter of the reel R increases.

The supports 3*a* and the paths of motion of the force device 5 allow the movement of the reel spool 2 within a short motion length which alters the distance of the reel spool 2 from the reeling cylinder 1. However, this motion length is considerably shorter than the travel of the carriage 3 effected by the transfer device 4, which path can be 2 meters or longer.

The force F effected by the force device 5 applying the load is adjustable. One of the most typical force devices which is used in reel-ups and is adjustable in force and capable of generating large loading forces, is a force device of a variable-length type driven by means of a pressurized medium such as a hydraulic cylinder. The hydraulic cylinder is coupled to a pressure source of hydraulic fluid, and the pressure which is effective in the hydraulic cylinder and at the same time determines the loading force F, can be adjusted in numerous ways as known in the art.

Basically, the transfer device 4 can be any device by means of which the carriage 3 can be positioned with respect to the reeling cylinder 1, and by means of which the carriage 3 can be moved further away from the reeling cylinder. The transfer device 4 is capable of positioning the carriage 3 rigidly into a predetermined fixed position with respect to the reeling cylinder 1. Most advantageously, such a transfer device 4 is a mechanical transfer device in which the movement of the carriage, and correspondingly the movement of the load supporting point B therein with respect to the fixed supporting point A, is attained by means of mechanical power transmission. Most advantageously, such a transfer device is a threaded bar which functions on a transfer screw principle and is in engagement with the corresponding inner thread. The threaded bar is arranged to be rotatable by means of a suitable power source M, and this power source is preferably arranged in such a way that the threaded bar is fastened rotatively in the fixed supporting point A, and its other end engages the corresponding inner thread, e.g., a threaded sleeve, in the carriage 3. Suitable power sources include servomotors. An example of a device operating by worm drive or transfer screw principle is a ball screw which can be used for accurate positioning.

Other mechanical transmissions which may be used include chain transmission and toothed rack transmission.

Furthermore, FIG. 2 shows that the support 3*a* of the reel spool 2 is arranged at such a height in the carriage 3 that during the transfer movement of the carriage 3, the central axis of the reel spool 2 lies in the horizontal plane extending via the central axis of the reeling cylinder 1, i.e., the angle of the radius drawn from the central axis of the reel to the nip N is 0°, wherein the weight of the reel R does not affect the nip load. Correspondingly, the supports 3*a* are directed in parallel with this horizontal plane such that the short motion path of the central axis of the reel spool 2, which is made possible by the supports 3*a*, coincides with this horizontal plane. However, the invention is not restricted solely to such a positioning which is advantageous as such, but it can also be utilized in reel-ups in which the aforementioned angle deviates from zero. The central axis of the reel spool 2 can be located above the horizontal plane which extends via the central axis of the reeling cylinder 1, and it can move in a plane parallel to this plane. The aforementioned angle can also be adjustable.

FIG. 3 shows the reel-up of FIG. 1 in the final stage of the reeling process. As shown therein, the transfer device 4 has moved the carriage 3 closer to the fixed supporting point A and the length of the force device 5 remains practically constant because it is not affected by the transfer movement which has occurred during the reeling process. However, the supporting point B of the force device has moved along with the movement of the carriage 3 with respect to the supporting point A.

FIG. 3 shows a situation where the reel R has reached its full size. After this, the loading with the force device 5 is terminated and the carriage 3 is moved by means of the transfer device 4 still further away from the reeling cylinder 1 in the machine direction. Thereafter, the web W runs freely from the mantle of the reeling cylinder 1 onto the reel R. A new empty reel spool 2 is brought from above in contact with the web W in such a way that the web remains between the reel spool 2 and the reeling cylinder 1, and a change is performed, i.e., the web is cut and its new end is guided around the new reel spool 2. The full reel R can be removed from the reel-up in a way described below. In the processes of bringing the new reel spool, cutting the web and guiding the web around the new reel spool, it is possible to use solutions known as such, which will not be described in more detail in this context.

FIGS. 2 and 3 show embodiments in which the supporting point B of the force device 5 is located in the carriage behind the reel spool 2 with respect to the reeling cylinder 1, i.e., the load is effected by pushing the reel spool 2 towards the reeling cylinder 1. Structurally this is the easiest alternative to implement, but it is also possible to arrange the load without deviating from the idea of the invention in such a way that the force device 5 and the supporting point B are on that side of the reel spool 2 where the reeling cylinder 1 is located, wherein the reel spool 2 is in a way pulled towards the reeling cylinder 1. Furthermore, it is possible to arrange the load effected by means of the force device 5 to be transmitted to the reel spool 2 with a special mechanism, as presented in FIG. 2*a*. In FIG. 2*a*, the force device 5 is located underneath the support 3*a*, and its other end is coupled to a lever 5*a* pivotally connected to the carriage 3 to pivot in the vertical plane, the upper end of the lever 5*a* being in contact with the end of the reel spool 2.

By means of the transfer device 4 functioning by mechanical power transmission, it is also possible to move such structures which do not bear the weight of the reel. Thus, one possible alternative can be various carriages and sledges which travel in linear guides and are equipped with force devices 5 and loading force supporting points B of their own for applying a load to the ends of the reel spool 2. In this case, the reel spool can be supported by fixed rails.

Furthermore, in FIG. 3, dashed lines illustrate the possibility to apply a load to the reel by means of rolling auxiliary means 6 in contact with its peripheral surface over a certain reel width, such as rolls or a belt brought around the rolls. This system can be used as an auxiliary load to balance the forces within the width of the reel, and it can be used to control the linear load in the reeling nip N. The rolling auxiliary means can be freely rotating, or they can be provided with a drive according to the drawings, wherein part of the drive of the reel R is performed by surface drive at the auxiliary means. One or more force devices 5 produce a loading force with a suitable mechanism. As shown in FIG. 3, the rolling auxiliary means 6 are placed in a construction 11 arranged movable in the carriage 3, in the situation shown in the drawing in an arm turning in the vertical plane. By means of this arm, the auxiliary means 6 can be moved in contact with the surface of the reel R and their position can be changed when the reel grows.

The load of the auxiliary means 6 can be implemented by means of the same transfer device with which the auxiliary means 6 are moved in contact with the reel R, or by means of a force device of their own which moves along with the construction 11 moved by the transfer device. In the former case, the load is implemented by means of a force device 5 located between the construction 11 and the carriage 3, and in the latter case, the load is implemented by means of a force device 5 located in the construction 11. The load effected by the auxiliary means 6 can be implemented in reel-ups functioning solely by surface drive with no drive on the reel spool 2, or in center-drive assisted reel-ups. Furthermore, the possibility is not excluded that at least at some stage of the reeling, the load is applied solely with these auxiliary means 6 which are in contact with the peripheral surface of the reel R. The effect of the auxiliary means can substantially extend over the entire width of the reel R, or they can be located in the middle zone of the reel, wherein the extension of their area of influence is advantageously symmetrical with respect to the reel, i.e., the center line of the web W accumulating on the reel. With the auxiliary means 6, it is possible to diversify the adjustment possibilities of the load, and they can be used to affect the nip profile in the reeling nip N.

The auxiliary means 6 can also be placed elsewhere than in the carriage 3 in the reel-up, in other words their supporting point can be located elsewhere, for example behind the carriage 3. In this case, they are arranged to be moved away from the path of the carriage if a reel which has reached its full size is moved backwards by means of the carriage.

FIGS. 2 and 3 also show how the fixed supporting point A of the transfer device 4 is located behind the carriage 3 when seen from the reeling cylinder 1, in other words, it is on the other side of the reel R in a suitable frame structure whose position is stationary with respect to the supporting base L. However, it is possible that the transfer device 4 and its supporting point A are located on the same side of the reel R with the reeling cylinder 1. The supporting point can in this case be located in the same frame structure in which the reeling cylinder 1 is journalled rotatably. The operating principles of the transfer device 4 and the methods with which it is fixed to the carriage 3 can thus be similar to those described above. It is also possible to use a combination of the aforementioned alternatives, wherein the carriage 3 is transferred with the transfer devices 4 simultaneously at its front and rear ends.

During the actual reeling process it is possible to utilize conventional principles to determine and adjust the loading force F, but since these principles do not fall within the scope of the invention, they are not discussed in more detail in this context. The loading force F is constantly adjusted in accordance with a principle depending on the paper grade and other conditions. Simultaneously with this continuous adjustment of the loading force F, the change in the distance between the reel spool 2 and the reeling cylinder 1 is monitored by means of a direct or indirect measuring method, and the carriage 3 is transferred by means of the transfer device 4 according to these changes, for example step by step.

According to a preferred embodiment, the nip force in the reeling nip N is measured by means of a force sensor. This is advantageous in the sense that friction, which is effective in such solutions where the reel rests and moves forward on rails, is not present in the force measurement. The force can be measured by means of a sensor either from the reeling cylinder or from the force device 5. The obtained value is compared with a set value, and it is used to adjust the control of the force devices 5. The method is particularly applicable to conventional heavy paper grades, such as newsprint, SC paper, fine papers and paperboard.

Figure 4:
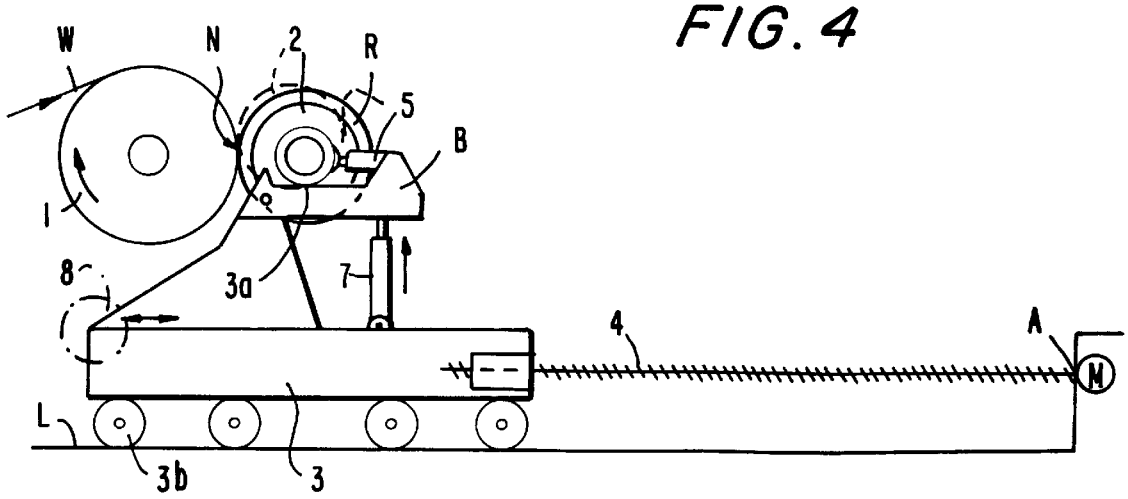
FIG. 4 shows a second embodiment of the reel-up in which the method and device accordance with the invention are employed.

FIG. 4 shows an embodiment in which the supports 3*a* supporting the reel spool at both ends are arranged movable on the carriage 3 in such a way that the location of the reel R on the periphery of the reeling cylinder 1 can be changed. This is implemented in such a way that the supports 3*a* are arranged in the carriage 3 to turn in a plane perpendicular to the rotation axes of the reel spool 2 and the reeling cylinder 1. The supports 3*a* can be turned by means of actuators 7, such as hydraulic cylinders, located between the supports 3*a* and the body of the carriage 3. The possibility to move the reel R along the periphery of the reeling cylinder 1 increases the possibilities to adjust the load, because thereby the mass of the reel R can also be utilized for applying the load when the reel R is transferred in such a way that the reeling nip N is shifted in the area above the horizontal plane extending via the rotation axis of the reeling cylinder 1. In a similar manner as in the preceding embodiment, the supporting point B of the force device 5, which adjusts the load, is located in the carriage 3, but it is situated in the supports 3*a* which is moved by an actuator 7 of its own.

By means of the pivotable supports 3*a*, it is also possible to move a new, empty reel spool 2 along the periphery of the reeling cylinder by lowering the supports 3*a*. The moving is already possible at that stage when the web W has not yet been cut and guided around the new reel spool.

Figure 5:
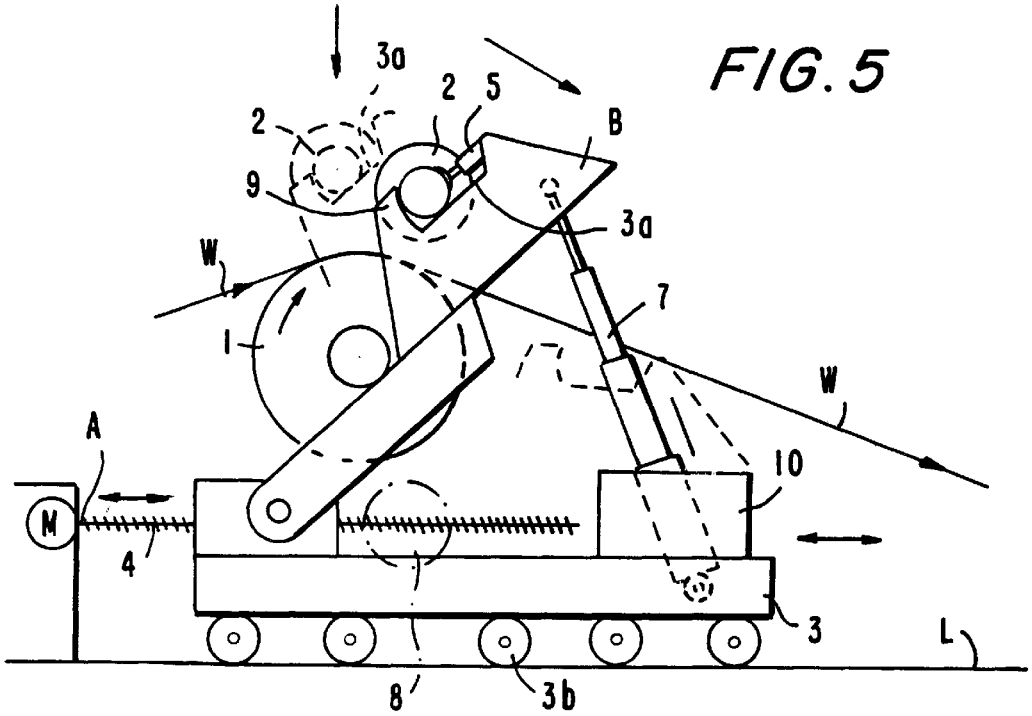
FIG. 5 shows an embodiment developed of the embodiment of FIG. 4.

FIG. 5 shows an embodiment developed from the embodiments of FIG. 4, in which embodiment the motion width of the supports 3*a* is so extensive that it is possible to replace primary reeling with them. The long supports 3*a* are pivotally connected to the carriage at a point as frontal as possible towards the incoming direction of the web. At the initial stage, the carriage is positioned in such a way that the pivot point is in front of the rotation axis of the reeling cylinder 1, as shown in FIG. 5. The motion width required by the supports 3*a* is attained by means of telescopically functioning actuators 7, which are pivotally attached to the vicinity of the free ends of the supports 3*a*. The supports 3*a* can be lifted up to receive the reel spool 2 lowered from the storage of reel spools, wherein the ends of the spool 2 are placed in the space between the end of the force device 5 and a holder 9 located in the support. By means of the transfer device 4, the carriage can be positioned in the machine direction in such a way that the nip between the reeling cylinder 1 and the reel spool 2 is open in the beginning and will close at a predetermined moment. To allow the supports 3*a* to pass the constructions supporting the ends of the reeling cylinder 1, they can be arranged pivotally sufficiently far away from the ends of the reeling cylinder 1 in the lateral direction. The carriage 3 is sufficiently wide at this point. Furthermore, the frame of the carriage 3 comprises a fixed base 10 which supports the lowerable supports 3*a* from underneath in the reeling position and bears the weight of the heavy machine reel R.

In the embodiments shown in FIGS. 4 and 5, it is also possible to use a loading mechanism according to FIG. 2*a*, in which the force devices 5 are located underneath the ends of the reel spool 2.

Figure 6:
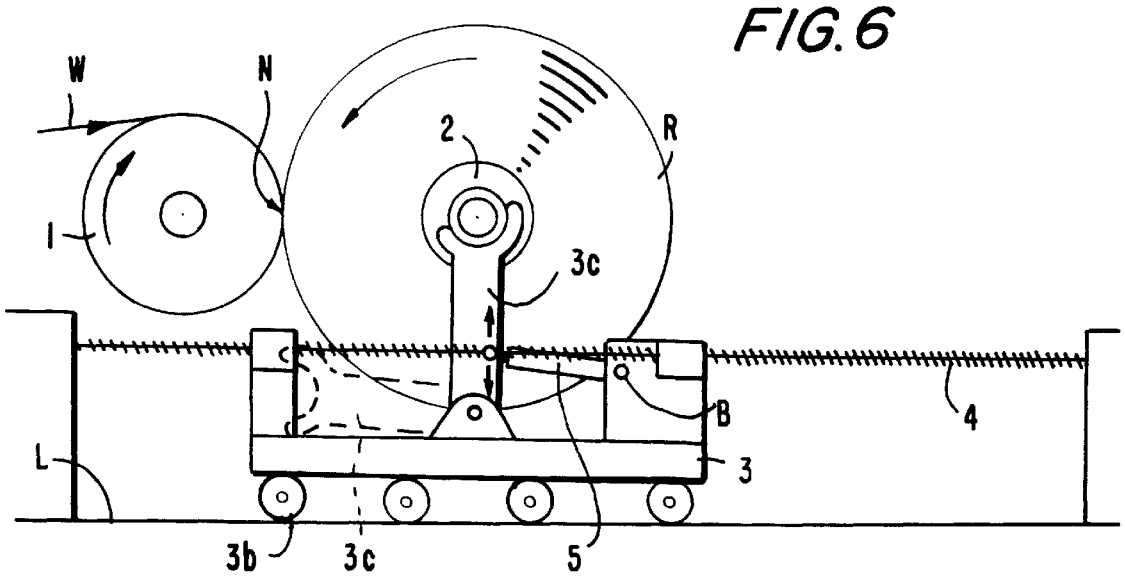
FIG. 6 shows a third embodiment of the reel-up in which the method and device in accordance with the invention are employed.

FIG. 6 shows a third embodiment in which the loading and the transfer of the carriage is carried out according to the same principle as above, but the force device 5 is coupled to vertical pivotal arms 3*c* which are pivotally connected to the carriage 3 and comprise fork-like upper ends which act on the ends of the reel spool 2. Thus, the force device 5 acts on the reel R via a mechanism provided by the pivotal arms 3*c*. In the longitudinal direction of the pivotal arms 3*c*, several fixing points are provided, in which one end of the force device can be fixed in a detachable manner, or one end of the force device 5 is pivotally attached to a slide which can be locked in different positions in the longitudinal direction of the pivotal arm 3*c*. By changing the fixing point of the force device 5 in the pivotal arm 3*c*, it is possible to alter the moment arm of the load, and thus within a given force range of the force device 5, it is possible to reach a certain loading range. By virtue of this, the force range of the force device, e.g., the pressure level of a hydraulic cylinder, can also be optimized. When the carriages 3 are changed by a system to be described in more detail below, the pivotal arms 3*c* can be turned to a lower position illustrated by the dashed lines. FIG. 6 shows that the ends of the reel spool 2 fully rest on the support of the arms 3*c*, and within a short turning distance of the arm the movement of the reel spool is nearly linear. However, a corresponding loading mechanism and change of the moment arm can also be used in carriages in which the ends of the reel spool 2 are separately supported from underneath by means of a support construction which allows a linear movement, and the pivotal arms are only used for applying a load towards the reeling cylinder.

Furthermore, in FIGS. 3–5, an auxiliary roll 8 is illustrated in dash-and-dot lines and can be movably arranged in the carriage 3 and brought in contact with the reel R which is becoming full in order to bind the surface layers of the web. This auxiliary roll 8 is brought in contact with the reel R for example shortly before cutting the web W, and the purpose of the auxiliary roll 8 is the same as the purpose of the roll presented in the aforementioned U.S. Pat. No. 5,251,835, i.e., to bind the surface layers together and to prevent air from entering the reel R at the stage where the web W runs between the reeling cylinder 1 and the reel R shifted away from the reeling cylinder 1. The auxiliary roll 8 can be replaced with other corresponding devices, for example with a brush device.

Figure 7:
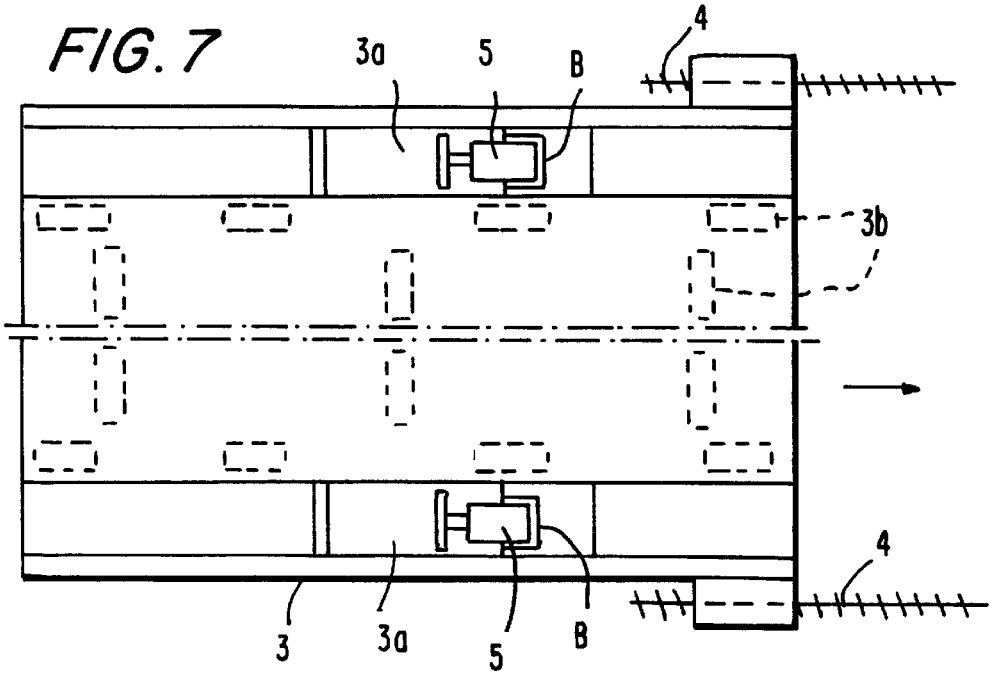
FIG. 7 shows a top view of a carriage used in the reeling process.

The carriage 3 is shown in more detail in FIG. 7. As mentioned above, the carriage is moved by means of wheels 3*b* rolling against a horizontal supporting base L. In the reeling position, i.e., when a load is applied to the reel R and the carriage 3 is simultaneously moved by means of the transfer device 4, the travel direction of the wheels 3*b* is parallel to the travel direction of the web W. The power transmission connection between the carriage 3 and the supporting point A is releasable so that the carriage 3 can be entirely removed from the reel-up. The transfer device 4 is arranged releasable from the carriage 3 for example in such a way that there are two transfer devices, one on each side of the carriage central axis extending in the transfer direction. In this event, the transfer devices can be easily detached and turned aside. Thereafter, the carriage 3 is moved away from the reel-up in a direction transverse to the travel direction of the paper web while being supported by the wheels 3*b*. Naturally, the travel direction of these wheels is transverse to the travel direction of the wheels 3*b* operating during the reeling. In practice, this can be provided by means of another set of wheels which is lowered down from the body of the carriage with suitable actuators, whereafter the first set of wheels can be lifted up by means of corresponding actuators. Another possibility is to use the same wheels 3*b*, wherein their axes are turned to correspond to the new travel direction, and to facilitate the turning, the carriage may be provided with separate lifting legs by means of which the wheels can be separated from the supporting base L so that the weight of the carriage 3 and the reel R does not interfere with the turning phase. Naturally, such lifting legs can function e.g. hydraulically.

The transfer of the carriage 3 in the transverse direction can be implemented by means of a suitable transfer device, for example, it can be pushed by the side with a separate transporting means. However, it is possible that the wheels 3*b* are provided with a drive, wherein the carriage is self-propelled by means of a power source which is connected to the wheels.

The transfer of the machine reel R with the same carriage 3 with which it has been supported during the reeling process, provides the advantage that a hall crane is not required, but the transfer is effected horizontally at the reeling height. Furthermore, when transferring the reel by the carriage 3 transversely with respect to the machine direction, the machine length can be considerably reduced when compared with a situation where the reel is removed from the reel-up directly rearward. However, the invention does not exclude the alternative that the reel is also removed from the reel-up with the carriage 3 rearward in the travel direction of the paper web, if there is space available for moving.

Figure 8:
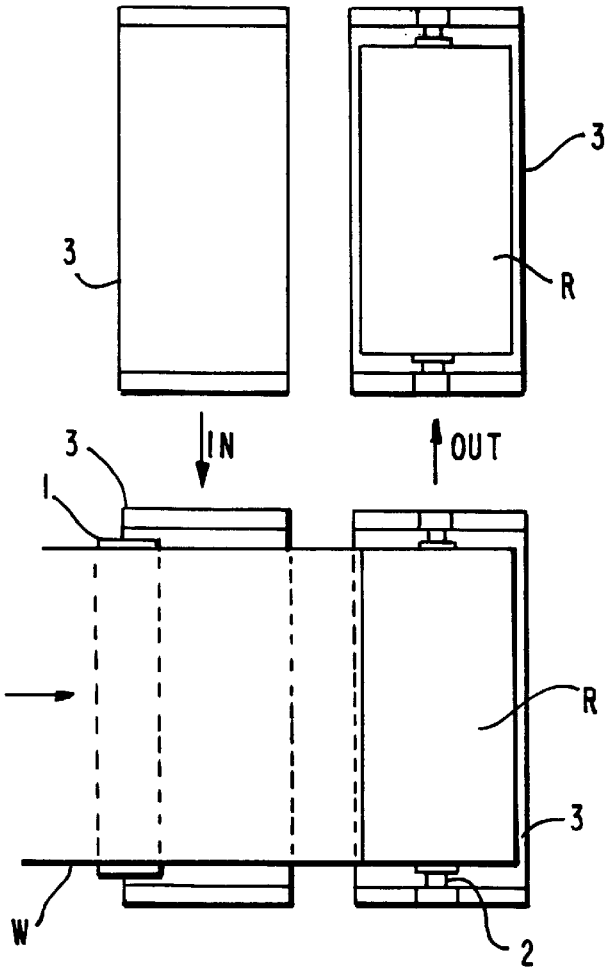
FIG. 8 shows as a schematic top view the method according to the invention and its application in the reel change and reel transport.

FIG. 8 illustrates the possibilities to use the carriage 3 and shows the floor level of a factory seen from above. It shows the above-described transfer of the full reel R away from the reel-up to further processing by means of the carriage 3 (arrow designated "Out"). Furthermore, the drawing shows the possibility to bring the carriages 3, which are used for transportation, empty to the reel-up in the return direction along a path running transversely to the travel direction of the paper web W and closer to the beginning of the paper web W (arrow designated "In"). The carriage 3 is driven either by means of an external transport device or by means of wheels of its own under the paper web W to a position behind the reeling cylinder 1, after which a new reel spool 2 can be lowered on the supports 3*a* of this carriage, and the reel can be changed in the way described hereinabove. The carriages 3 can be dimensioned to be so short in the machine direction that they can be placed one after the other in the reel-up so that the carriage 3 which has just been brought therein supports the empty reel spool 2, and the carriage 3, which has moved in the reel-up earlier, is located behind it with the full reel R thereon.

Furthermore, it is possible to use a structure according to FIG. 2*a*, wherein the carriage better fits underneath the web W from the side, the web W traveling before the change in a sloping position downward onto the reel R being completed, as shown in FIG. 5.

In the new carriage 3 which is brought to the reeling position, the wheels 3*b* are arranged analogically with the removal stages of the carriage in such a way that the carriage can start moving to the machine direction again. To facilitate the process of driving the carriage under the paper web W, the supporting base L is not provided with rails running in the machine direction, but the transfer path of the carriage 3 is guided to the machine direction merely by the transfer device 4 and possible auxiliary guides which guide the carriage 3 elsewhere than by the wheels 3*b* and which can be movable to their place for the duration of the reeling process. However, the invention is not restricted solely to such embodiments in which the supporting base L is even and devoid of rails, but the invention can also be applied in such reel-ups in which the supporting base L is provided with rails guiding the wheels 3*b* of the carriage. As mentioned above, the carriage 3 can also move in the machine direction on the support of other conveying means than wheels. The same conveying means can also be used for moving the carriage 3 in the transverse direction away from the reel-up and/or back to the reel-up.

When the carriage 3 is transferred into the initial position of the reeling, in which the empty reel spool 2 is placed on top of the carriage 3, the carriage 3 is coupled to the transfer device 4, and the coupling can take place for example automatically. Because the force device 5 and correspondingly the reel spool 2 have a small possibility of motion in the transfer direction of the carriage 3, it is not necessary to perform a completely accurate positioning by means of the transfer device 4, but by means of the force device 5 the reel R always finds its way against the reeling cylinder 1. The loading force F can also be kept on a desired level when the position of the reel spool 2 in the carriage 3 and correspondingly the position of the force device slightly change.

In the invention, it is possible to use several operating principles known from reel-ups without changing them, for example the adjustment of the load and the arrangement of sensors. Similarly, the center-drive in the reel spool 2 can be arranged in ways of prior art.

Furthermore, it is possible to use a device according to the invention in such a way that the reel R is driven so that the nip N is open, but in that case the force devices 5 have to be provided with position sensors.

The invention is applicable for the reel-ups of all paper webs, in which a continuously growing reel is loaded against the reeling cylinder. The term paper web refers to all such materials in a form of a continuous web which are produced of fibrous pulp in a paper or board machine and for the reeling of which the invention is applicable irrespective of the fibrous raw material or the grammage. The invention is especially well applicable to the reeling of heavy machine reels from full-width webs emerging from paper machines or paper finishing apparatuses which continuously produce paper web for reeling. In heavy machine reels the weight of the paper in the complete reel clearly exceeds the weight of the reel spool 2, and such machine reels are typically attained from paper grades "heavier' than tissue papers, e.g. from different printing paper and paperboard grades.

We claim:

1. A method for applying a load to a reel in a reel-up of a paper web, in which a reel is wound around a reel spool from the paper web in a machine direction, comprising the steps of:

loading the reel spool and the reel against a web guiding means with a loading force;

supporting the loading force by a supporting point located in a carriage movable at least in the machine direction along with the reel spool and bearing at least partly the weight of the reel;

positioning the carriage with respect to a fixed supporting point in accordance with the growth of the reel by means of a transfer device located between the carriage and the fixed supporting point;

moving a full reel away from the reel-up with the same carriage which has supported the reel spool and the reel during reeling;

during a reel change, moving an empty carriage into the reel-up under the paper web running towards an old reel, placing the empty reel spool in the reeling carriage, and guiding the paper web around the empty reel spool.

2. A method according to claim 1, wherein the transfer device operates by means of mechanical power transmission.

3. A method according to claim 1, wherein the step of loading the reel spool comprises the step of:

arranging a force device capable of generating a loading force between the supporting point in the carriage and the reel spool, and adjusting the loading force generated by the force device during reeling.

4. A method according to claim 3, wherein the force device is a pressurized medium-driven force device, the pressure of the pressurized medium acting in the force device being adjustable.

5. A method according to claim 1, further comprising the step of:

adjusting the position of the reel spool with respect to the web guiding means by means of movable supports located in the carriage.

6. A method according to claim 5, wherein the web guiding means is a rotatable reeling cylinder arranged to rotate around a rotation axis and the position of the reel spool that is adjusted by means of the movable supports located in the carriage is an angular position of the reel spool with respect to the rotation axis of the rotatable reeling cylinder.

7. A method according to claim 5, further comprising the steps of:

lifting the supports upward to receive an empty reel spool, and transferring the empty reel spool on the supports.

8. A method according to claim 1, wherein the step of positioning the carriage comprises the step of:

moving the carriage during reeling so that it is supported by conveying means resting directly or indirectly on a supporting base.

9. A method according to claim 1, wherein the step of positioning the carriage comprises the step of:

moving the carriage during reeling so that it is supported by conveying means resting directly or indirectly on a supporting base.

10. A method according to claim 8, wherein the conveying means are wheels arranged on the carriage.

11. A method for applying a load to a reel in a reel-up of a paper web, in which a reel is wound around a reel spool from the paper web in a machine direction, comprising the steps of:

loading the reel spool and the reel against a web guiding means with a loading force;

supporting the loading force by a supporting point located in a carriage movable at least in the machine direction along with the reel spool and bearing at least partly the weight of the reel;

positioning the carriage with respect to a fixed supporting point in accordance with the growth of the reel by means of a transfer device located between the carriage and the fixed supporting point;

moving a full reel away from the reel-up with the same carriage which has supported the reel spool and the reel during reeling; and during a reel change, transferring an empty carriage under the paper web running towards an old reel such that the carriage moves supported by conveying means resting directly or indirectly on a supporting base.

12. A method for applying a load to a reel in a reel-up of a paper web, in which a reel is wound around a reel spool from the paper web in a machine direction, comprising the steps of:

loading the reel spool and the reel against a web guiding means with a loading force;

supporting the loading force by a supporting point located in a carriage movable at least in the machine direction along with the reel spool and bearing at least partly the weight of the reel;

positioning the carriage with respect to a fixed supporting point in accordance with the growth of the reel by means of a transfer device located between the carriage and the fixed supporting point; and transferring the fill reel away from the reel-up by moving the carriage in a transverse direction with respect to the incoming direction of the paper web.

13. A method according to claim 12, further comprising the step of:

directing an empty carriage into the reel-up in a direction transverse to the incoming direction of the paper web.

14. A device for applying a load to a reel in a reel-up of a paper web, comprising:

a reel spool arranged to receive the paper web to form a reel of paper therearound having a radius showing a direction of growth caused by the paper web accumulating on the reel, the reel-up including web guiding means for guiding the web onto the reel spools, a movable construction arranged to contact the reel spool and for movement in the growth direction of the radius of the reel in order to move the reel spool in the growth direction;

loading means for loading the reel against the web guiding means, said loading means being structured and arranged in connection with said construction;

positioning and transfer means separate from said loading means for moving and positioning said construction in the growth direction of the radius of the reel, wherein said construction comprises a carriage and arms pivotably mounted to said carriage and contacting ends of the reel spool, said pivotal arms being coupled to said loading mean; and wherein said loading means and said pivotal arms are arranged such that a point of action of said loading means on said pivotal arms is adjustable in a longitudinal direction of said pivotal arms.

15. A device according to claim 14, wherein said loading means comprise a pressurized medium-driven force device.

16. A device according to claim 14, wherein said positioning and transfer means comprises a rotatable screw fixed at one end and threadingly engaging with said construction such that rotation of said screw causes movement of said construction.

17. A device according to claim 14, wherein said construction comprises supports having a longitudinal direction supporting ends of the reel spool and for allow movement of the reel spool in the longitudinal direction of the supports to thereby enable the distance of the reel spool from the web guiding means to vary.

18. A device according to claim 14, wherein the web guiding means include a reeling cylinder arranged to rotate about a rotation axis, said construction comprising supports supporting ends of the reel spool and being movable substantially in the direction of the periphery of the reeling cylinder, said supports being arranged to change the angular position of the reel spool with respect to the rotation axis of the reeling cylinder.

19. A device according to claim 14, wherein the reel-up includes auxiliary means arranged to be moved into contact with a peripheral surface of the reel and a force device for loading the auxiliary means against the reel.

20. A device according to claim 14, wherein the web guiding means are mounted in a stationary position with respect to a frame of the reel-up.

21. A device according to claim 20, wherein the web guiding means is a reeling cylinder arranged rotatable in a stationary position.

22. A device for applying a load to a reel in a reel-up of a paper web, comprising:

a reel spool arranged to receive the paper web to form a reel of paper therearound having a radius showing a direction of growth caused by the paper web accumulating on the reel the reel-up including web guiding means for guiding the web onto the reel spools, a carriage partially bearing the weight of the reel and being movable in the growth direction of the radius of the reel in order to move the reel spool in the growth direction;

loading means for loading the reel against the web guiding means, said loading means being structured and arranged in connection with said carriage;

positioning and transfer means separate from said loading means for moving and positioning said carriage in the growth direction of the radius of the reel;

wherein said carriage comprises conveying means for supporting said carriage directly or indirectly against a supporting base when the carriage is moved;

wherein said conveying means of said carriage are arranged to travel in two directions transverse to each other.

23. A device according to claim 22, wherein said positioning and transfer means comprise a mechanical power transmission device arranged to move and position said carriage in the growth direction of the radius of the reel with respect to a fixed supporting point.

24. A device according to claim 22, wherein said positioning and transfer means comprises a rotatable screw fixed at one end and threadingly engaging with said carriage such that rotation of said screw causes movement of said carriage.

25. A device according to claim 22, wherein said carriage comprises supports having a longitudinal direction supporting ends of the reel spool and for allowing movement of the reel spool in the longitudinal direction of the supports to thereby enable the distance of the reel spool from the web guiding means to vary.

26. A device according to claim 22, wherein the web guiding means include a reeling cylinder arranged to rotate about a rotation axis, said carriage comprising supports supporting ends of the reel spool and being movable substantially in the direction of the periphery of the reeling cylinder, said supports being arranged to change the angular position of the reel spool with respect to the rotation axis of the reeling cylinder.

27. A device according to claim 22, wherein said conveying means comprise wheels.

28. A device according to claim 22, wherein said conveying means comprise wheels.

29. A device according to claim 22, wherein the web guiding means are mounted in a stationary position with respect to a frame of the reel-up.

30. A device according to claim 29, wherein the web guiding means include a reeling cylinder arranged rotatable in a stationary position.

* * * * *